US006998937B2

(12) United States Patent
Brown et al.

(10) Patent No.: US 6,998,937 B2
(45) Date of Patent: Feb. 14, 2006

(54) CONTROLLING A PHASE DELAY LINE BY ADDING AND REMOVING A FLUIDIC DIELECTRIC

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/656,949

(22) Filed: Sep. 4, 2003

(65) Prior Publication Data

US 2005/0052260 A1 Mar. 10, 2005

(51) Int. Cl.
*H01P 1/18* (2006.01)

(52) U.S. Cl. ..... 333/161; 333/156; 333/245

(58) Field of Classification Search ..... 333/161, 333/156, 157, 159, 160, 245, 248
See application file for complete search history.

(56) References Cited

U.S. PATENT DOCUMENTS

| | | | | |
|---|---|---|---|---|
| 3,701,058 | A * | 10/1972 | Smith | 333/159 |
| 5,162,972 | A | 11/1992 | Gripshover et al. | |
| 6,443,179 | B1 * | 9/2002 | Benavides et al. | 137/454.2 |
| 6,515,235 | B1 | 2/2003 | Moller | |
| 2001/0017577 | A1 * | 8/2001 | Toko et al. | 333/161 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.

(Continued)

*Primary Examiner*—Stephen E. Jones
(74) *Attorney, Agent, or Firm*—Sacco & Associates, PA

(57) ABSTRACT

A variable phase delay line (100). The variable phase delay line (100) can include an RF transmission line (102) and a fluid channel (130) having a serpentine configuration. The fluid channel (130) can be coupled to the RF transmission line (102) along at least a portion of a length of the transmission line (102). The variable phase delay line (100) also can include at least one fluid control system (150) for adding and removing the fluidic dielectric (132) to the fluid channel (130) in response to a phase delay control signal (122) to selectively vary a phase delay of the RF transmission line (102). The fluidic dielectric (132) can have a permeability and a permittivity selected for maintaining a constant characteristic impedance along an entire length of the RF transmission line (102).

23 Claims, 3 Drawing Sheets

OTHER PUBLICATIONS

U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.

* cited by examiner

CONTROLLING A PHASE DELAY LINE BY ADDING AND REMOVING A FLUIDIC DIELECTRIC

BACKGROUND OF THE INVENTION

1. Statement of the Technical Field

The present invention relates to the field of phase delays, and more particularly to variable phase delays.

2. Description of the Related Art

Delay lines such as phase delays are used for a wide variety of signal processing applications. For example, broadband phase delay circuits are used in beam-forming applications in phased array antennas. Typical fixed geometry, true phase delay circuits used in phased array antennas are comprised of switched lengths of transmission line. Despite the importance of broadband delay lines in such systems, the conventional approach to designing and implementing these components suffer from a number of drawbacks. For example, conventional delay line devices often require a relatively large number of RF switches that can result in signal losses. Also, conventional phase delay circuits can be limited with regard to the delay resolution that can be achieved.

RF delay lines are often formed as ordinary transmission lines coupled to a dielectric. Depending upon the structure of the transmission line, the dielectric can be arranged in different ways. For example, microstrip and stripline circuits commonly are formed on a dielectric substrate. Two important characteristics of dielectric materials are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly affects the electrical length of a transmission line and therefore the amount of delay introduced to signals that traverse the line.

Further, ignoring loss, the characteristic impedance of a transmission line, such as stripline or microstrip, is equal to $\sqrt{L_1/C_1}$ where $L_1$ is the inductance per unit length and $C_1$ is the capacitance per unit length. The values of $L_1$ and $C_1$ are generally determined by the permittivity and the permeability of the dielectric material(s) used to separate the transmission line structures as well as the physical geometry and spacing of the line structures. For a given geometry, an increase in dielectric permittivity or permeability necessary for providing increased phase delay will generally cause the characteristic impedance of the line to change. However, this is not a problem where only a fixed delay is needed, since the geometry of the transmission line can be readily designed and fabricated to achieve the proper characteristic impedance.

When a variable phase delay is needed, however, such techniques have traditionally been viewed as impractical because of the obvious difficulties in dynamically varying the permittivity and/or permeability of a dielectric board substrate material and/or dynamically varying transmission line geometries. Variable length lines have been implemented using mechanical means to vary the length of a line. These generally have involved an arrangement of telescoping tubes to produce a variable length coaxial line. These devices were at one time commonly used in laboratories for tuning circuits. However, these arrangements suffered from certain drawbacks. For example, they were subject to wear, difficult to control electronically, and are not easily scalable to microwave frequencies. Accordingly, the solution has been to design variable phase delay lines using conventional fixed length RF transmission lines with delay variability achieved using a series of electronically controlled switches.

Ferroelectric materials are also sometimes used to implement compact variable phase delays for various applications. The phase delay can be implemented by applying a bias electric field to the ferroelectric material, which changes the permittivity of the material. The use of ferroelectric material in the microwave frequency range has been limited, however, due to high losses associated with these materials and due to the high electric field necessary to bias the structure in order to obtain substantial permittivity change.

A microwave phase shifter is a device which can be used for varying phase in the microwave frequency range. The microwave phase shifter is a thin-film ferroelectric/ferrite device. A microwave phase shifter can be tuned by varying both electric and magnetic fields. For instance, the propagation velocity of electromagnetic waves in the microwave phase shifter can be varied by applying an electric field to vary the permittivity of the ferroelectric layer and/or varying an applied magnetic field to vary the permeability of the ferrite layer. In operation, the microwave phase shifter is limited to a phase shift of about 300°. Moreover, a magnetic field of greater than 800 Gauss is required to achieve this phase shift. Such a magnetic field can interfere with the operation of other circuit devices which are proximate to the microwave phase shifter. Further, the microwave phase shifter is not suitable for use in monolithic microwave integrated circuits.

SUMMARY OF THE INVENTION

The current invention relates to a phase delay line. The phase delay line can include an RF transmission line and a fluid channel having a serpentine configuration. The fluid channel can be coupled to the RF transmission line along at least a portion of a length of the transmission line. The phase delay line also can include at least one fluid control system for adding and removing a fluidic dielectric to the fluid channel in response to a phase delay control signal. A phase delay of the RF transmission line can be selectively varied by adding and removing the fluidic dielectric from the fluid channel. Further, the phase delay of the RF transmission line can be maintained constant as an operational frequency of the RF transmission line is varied. Moreover, the fluidic dielectric can have a permeability and a permittivity selected for maintaining a constant characteristic impedance along an entire length of the RF transmission line.

The transmission line can also be coupled to a solid dielectric substrate material. The solid dielectric substrate can be formed from a low temperature co-fired ceramic material. The permittivity and/or permeability of the fluidic dielectric can be different as compared to the dielectric substrate. For example, the fluidic dielectric can include an industrial solvent. Further, a suspension of magnetic particles contained within the solvent. For example, the magnetic particles can be ferrite, metallic salts, or organometallic particles.

The current invention also relates to a method for producing a phase delay for an RF signal. The method includes the steps of propagating the RF signal along an RF transmission line and adding a fluidic dielectric into a fluid channel having a serpentine configuration. The fluid channel is coupled to the RF transmission line along at least a portion of a length of the transmission line. The fluidic dielectric can be added to the fluid channel to selectively control the coupling, and thereby vary a phase delay of the transmission line. The fluidic dielectric also can be added to the fluid channel to selectively control the coupling, and thereby maintain a constant phase delay of the transmission line while an operational frequency of the transmission line is varied. The method also includes the step of removing the fluidic dielectric from the fluid channel. Further, the permeability and/or permittivity of the fluidic dielectric can be selected for maintaining a constant characteristic impedance along an entire length of the RF transmission line. The method also can include the step of coupling the transmission line to a solid dielectric substrate material.

DETAILED DESCRIPTION OF THE INVENTION

The present invention relates to a method and a system for controlling a phase delay of an RF transmission line by coupling a fluidic dielectric to the RF transmission line. A phase delay of the RF transmission line can be selectively varied by adding and removing the fluidic dielectric from a fluid channel proximately located to the RF transmission line. Further, the phase delay of the RF transmission line can be maintained constant as an operational frequency of the RF transmission line is varied. Moreover, the fluidic dielectric can have a permeability and a permittivity selected for maintaining a constant characteristic impedance along an entire length of the RF transmission line.

The fluidic dielectric can vary a permittivity ($\epsilon$) and/or a permeability ($\mu$) in a region proximate to the transmission line. Since the propagation velocity of a signal is approximately inversely proportional to $\sqrt{\mu\epsilon}$, the change in permittivity and/or permeability of the region will cause the propagation velocity (and therefore the amount of phase delay introduced) to be different for signals on the portion of the transmission line coupled to the fluidic dielectric. For example, the fluidic dielectric can be coupled to the transmission line to increase $\sqrt{\mu\epsilon}$ in the region, and thus decrease a propagation velocity of a signal on the transmission line.

Figure 1:
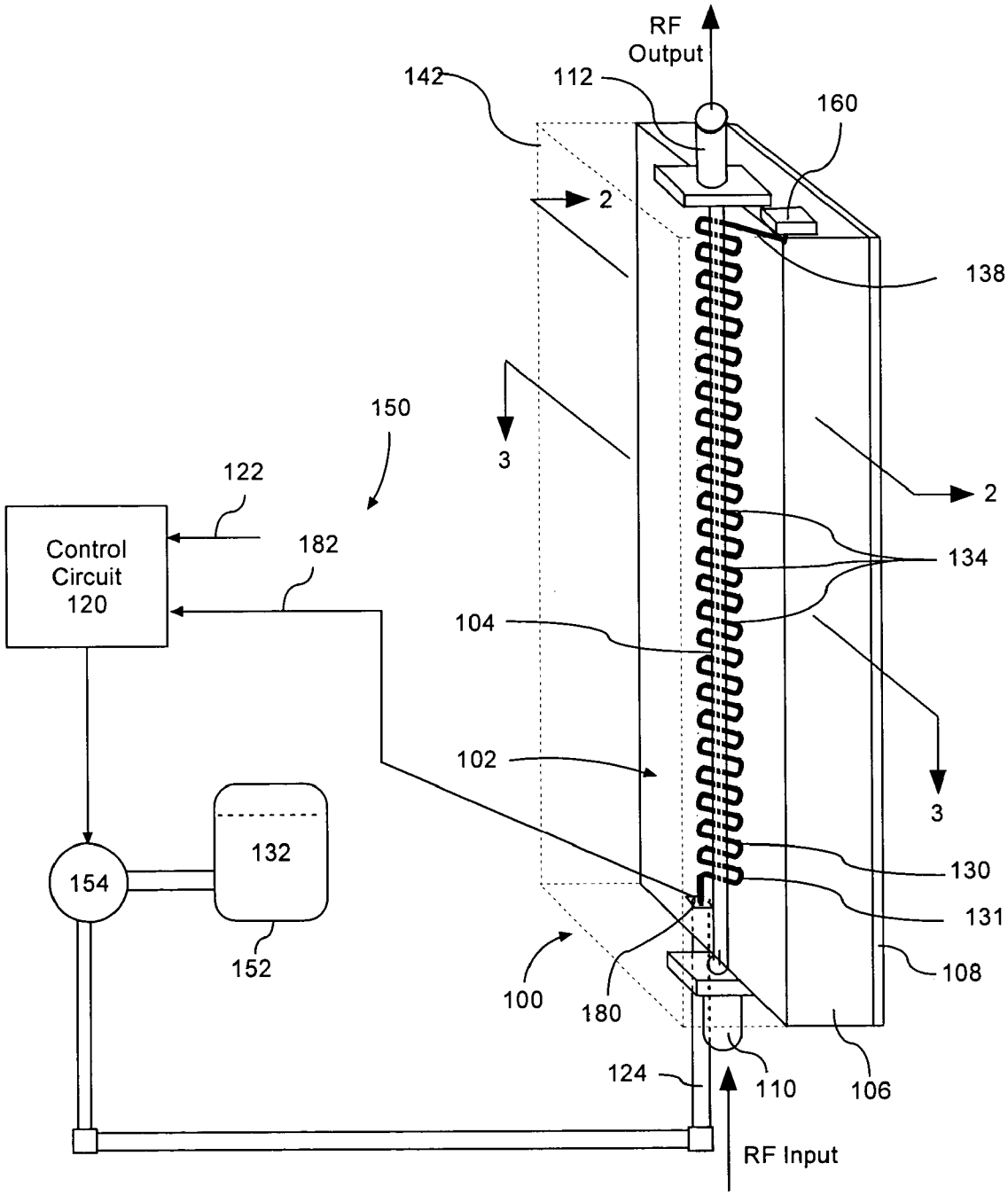
FIG. 1 is a perspective view of a variable phase delay line that is useful for understanding the invention.

FIG. 1 is a perspective view of a phase delay line that is useful for understanding the present invention. The phase delay line 100 includes an RF transmission line 102. The RF transmission line 102 is comprised of a conductor 104 disposed on a substrate 106 positioned over a suitable ground plane 108. However, the invention is not limited to any particular type of transmission line. Instead, it should be understood that the invention as described herein can be used with any type of transmission line structure that can be coupled to a fluid channel as shall hereinafter be described in greater detail. RF input connector 110 and RF output connector 112 can be provided for communicating RF signals to and from the phase delay line 100. However, the delay line also can be integrated onto a circuit board with other associated circuitry so as to avoid the need for such connectors.

One or more fluid channels 130 can be embedded within the substrate 106. The fluid channel 130 preferably extends adjacent to a region of the transmission line conductor 104 so that fluidic dielectric 132 contained in the fluid channel can be electrically and magnetically coupled to the fields that are generated when RF signals are propagated along the transmission line. For example, the fluid channel 130 can be positioned beneath the transmission line conductor 104. In operation, fluidic dielectric 132 can be injected into the fluid channel 130 to adjust the permittivity and/or permeability of the region defined by the fluid channel 130.

According to one embodiment of the invention, the fluid channel 130 can be formed as an elongated channel traversing in a serpentine fashion beneath transmission line conductor 104. In particular, the fluid channel 130 can be provided with a plurality of fluid channel segments 134 that extend beneath the transmission line conductor 104. Any number of fluid channel segments 134 can be provided, depending on the amount of phase shift control that is desired. For instance, a greater number of fluid channel segments 134 can provide a greater range of phase adjustment.

Figure 2:
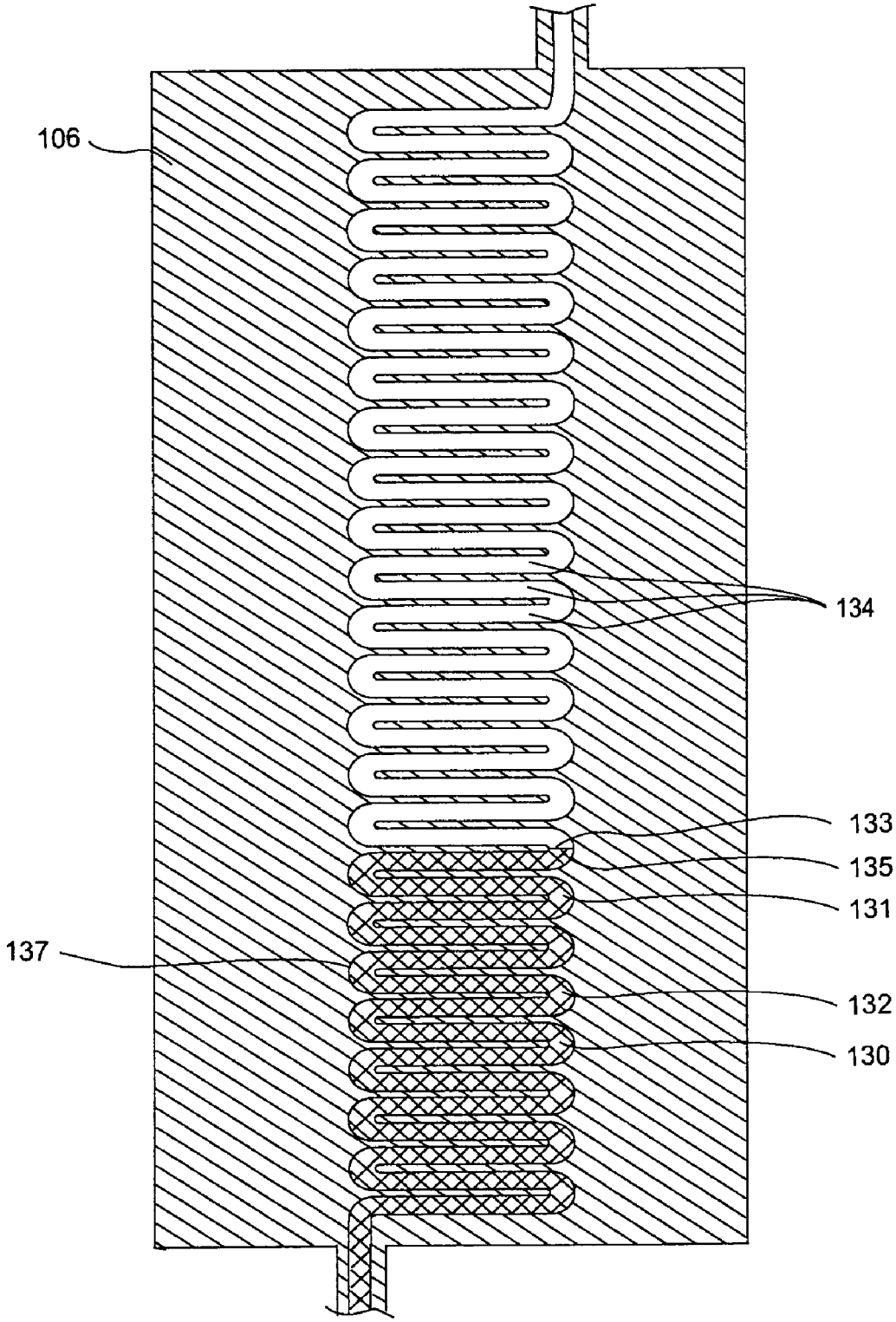
FIG. 2 is a cross-sectional view of the variable phase delay line in FIG. 1 taken along line 2—2.
Figure 3:
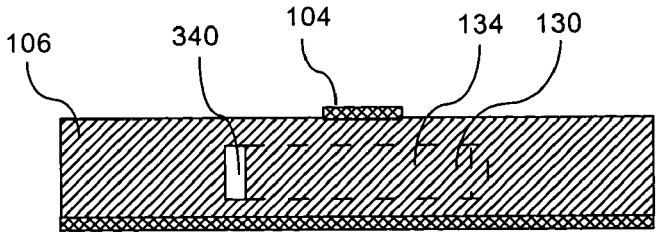
FIG. 3 is a cross-sectional view-of the variable phase delay line in FIG. 1 taken along line 3—3.

Referring now to FIGS. 2 and 3, there is shown a cross-sectional view of the variable delay line taken along line 2—2 and 3—3, respectively, in FIG. 1. The dimensions of each channel segment 134 can be selected to contain an amount of fluidic dielectric within the channel segment 134 which is necessary to effectuate a desired minimum change in propagation velocity of a signal on the transmission line 102. Accordingly, each channel segment 134 can provide a specific phase adjustment at a particular operating frequency when filled with fluidic dielectric 132. For example, the dimensions of each channel segment 134 can be selected to provide ½° of phase adjustment. In operation, the amount of fluidic dielectric 132 which is injected into the fluid channel 130 can be determined by the number of channel segments 134 that need to be filled to effectuate the desired amount of phase adjustment.

By subsequently purging the fluidic dielectric 132 from the channel segments 134, the phase again can be adjusted. For example, the permittivity and permeability within one or more channel segments 134 can become equal, or substantially equal, to the permittivity and permeability of a vacuum or some other gas or fluid which is used to displace the fluidic dielectric 132. In one embodiment, the fluidic dielectric 132 can be replaced with a second fluidic dielectric having a different permittivity and/or permeability than the first fluidic dielectric 132.

Although the fluid channel 130 is shown as having a rectangular cross section 340 in FIG. 3, the invention is not so limited. Importantly, the fluid channel 130 can have any desired dimensions. For example, the cross section 340 of the fluid channel 130 can be circular, oval, triangular, square, or have any other desired shape.

Referring again to FIG. 1, a fluid control system 150 is preferably provided for selectively controlling the presence or removal of the fluidic dielectric 132 from the fluid channel 130. The fluid control system 150 can comprise any suitable arrangement of pumps, valves, conduits and controllers that are operable for effectively injecting and removing fluidic dielectric 132, or any other fluid or gas, from the fluid channel in response to a control signal 122. A wide variety of such fluid control systems may be implemented by those skilled in the art. For example, in one embodiment, the fluid control system can include a reservoir 152 for fluidic dielectric 132 and a pump 154 for injecting the fluidic dielectric into the fluid channel 130 by means of a suitable fluid transfer conduit 124.

The top 138 of the fluid channel 130 can be sealed so that a vacuum is formed within the fluid channel 130 when the fluidic dielectric 132 is not contained within, or is purged from, the fluid channel 130. Alternatively, a valve 160 can be provided to enable an existing fluid, such as air, contained within the fluid channel 130 to be passed out of the fluid channel while the fluidic dielectric 132 is injected. The fluid can be selected such that the fluid is immiscible with air to prevent the fluid and the air from mixing. In one arrangement, the valve 160 can prevent the spillage of dielectric fluid 132. For instance, the valve can pass certain fluids, such as air, while preventing the fluidic dielectric 132 from passing. When it is desired to purge the fluidic dielectric 132 from the fluid channel 130, the pump 154 can draw the fluidic dielectric 132 from the fluid channel 130 back into reservoir 152. The valve 160 can allow air to return into the fluid channel 130.

Referring to FIGS. 1 and 2, when injected into the fluid channel 130, the fluidic dielectric 132 preferably progresses through the fluid channel 130 such that the channel segments 134 are sequentially filled. For example, the transmission line 102 can be vertically oriented as shown. In this arrangement, the force of gravity can help maintain the fluidic dielectric 132 continuous through a lower portion 137 of the fluid channel 130. In another arrangement, the cross sectional area of the fluid channel 130 can be selected so that a surface tension of the fluid dielectric 132 is sufficient to keep pockets of vacuum, air, or any other undesirable fluid from forming within the fluidic dielectric 132.

Surface tension can prevent undesirable fluid mixing even if the transmission line 102 is disposed in a horizontal position, or the fluidic dielectric is injected from a top portion of the transmission line 102. Surface tension results from the cohesive forces between fluid molecules. Specifically, molecules at the surface 133 of a fluidic dielectric 132 do not have other like molecules on all sides of them. Consequently the molecules cohere more strongly to those molecules with which they are directly associated on the surface 133 of the fluidic dielectric 132. This forms a surface barrier which resists the movement of an object through the surface. Further, the fluidic dielectric 132 also can adhere to the wall 131 of the fluid channel 130, which helps to maintain a uniform fluidic dielectric surface as the fluidic dielectric 132 is injected and purged from the channel 130. In the present invention, the level of surface tension of the fluidic dielectric 132 and the level of adhesion between the fluidic dielectric 132 and the wall 131 of the channel 130 are preferably large enough so that a leading portion 135 of the fluidic dielectric 132 forms a fluid surface 133 which remains substantially perpendicular to the wall 131 of the fluid channel 130.

A control circuit 120 can control the operation of the pump 154 to inject and purge the fluidic dielectric from the fluid channel. The control circuit 120 can be responsive to an analog or digital control signal 122 for selectively controlling the presence and removal of the fluidic dielectric from the fluid channel. A sensor 180 can be provided to monitor the amount of fluidic dielectric 132 injected or removed from the fluid channel 130. Alternatively, a sensor can be disposed along a length of the fluid channel 130 to detect a fluidic dielectric level within fluid channel 130. The sensor can generate sensor data 182 which can be communicated back to the controller 120 to provide feedback information regarding the volume of fluid contained within the fluid channel 109. The control circuit 120 can correlate the amount of fluid injected or removed to an amount of phase delay which is required. Alternatively, the control circuit 120 can monitor the phase delay of the transmission line 102 and inject or remove fluidic dielectric 132 from the fluid channel 130 until a desired phase delay is achieved.

It should be understood that the fluid control system 150 is merely one possible implementation among many that could be used to inject and purge fluidic dielectric from the fluid channel and the invention is not intended to be limited to any particular type of fluid control system. All that is required of the fluid control system is the ability to effectively control the presence and removal of the fluidic dielectric 132 from the fluid channel 130.

According to a preferred embodiment, the permittivity and the permeability of the fluidic dielectric is selected so as to maintain a constant characteristic impedance ($Z_0$) for the transmission line 102 along its length. In general, this can be accomplished by maintaining an approximately constant ratio of permittivity to permeability. However, the invention is not so limited in that relatively small mismatches in impedance between portions of the line may be tolerable, or even desired, in certain applications. For instance, the permittivity and the permeability of the fluidic dielectric can be selected to vary the characteristic impedance.

As previously noted, the invention is not limited to any particular type of transmission line structure. For example, in FIG. 1, an optional substrate layer 142 can be disposed over the conductor 111 to create a buried microstrip arrangement. Further, the position of the fluid channel 130 relative to the transmission line conductor 104 can be adjusted so that the transmission line conductor 104 passes directly through the fluid channel 130.

Composition of the Fluidic Dielectric

The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular phase delay and transmission line characteristic impedance. In this regard, it will be readily appreciated that fluid miscibility is a key consideration to ensure proper mixing of the component parts of the fluidic dielectric.

The fluidic dielectric 132 also preferably has a relatively low loss tangent to minimize the amount of RF energy lost in the delay line device. However, devices with higher insertion loss may be acceptable in some instances so this may not be a critical factor. Many applications also require delay lines with a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_r$) for fluids is approximately 2.0. However, the fluidic dielectric 132 used herein can include fluids with higher values of permittivity. For example, the fluidic dielectric material could be selected to have a permittivity values of between 2.0 and about 58, depending upon the amount of delay required.

Similarly, the fluidic dielectric 132 can have a wide range of permeability values. High levels of magnetic permeability are commonly observed in magnetic metals such as Fe and Co. For example, solid alloys of these materials can exhibit levels of $\mu r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 19 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing the same hydrocarbon fluid with magnetic particles such as magnetite manufactured by Ferro Tec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particles. Fluids containing electrically conductive magnetic particles require a mix ratio low enough to ensure that no electrical path can be created in the mixture. Solvents, such as formamide, inherently possess a relatively high permittivity.

Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Controlling the Variable Displacement Processor

Figure 4:
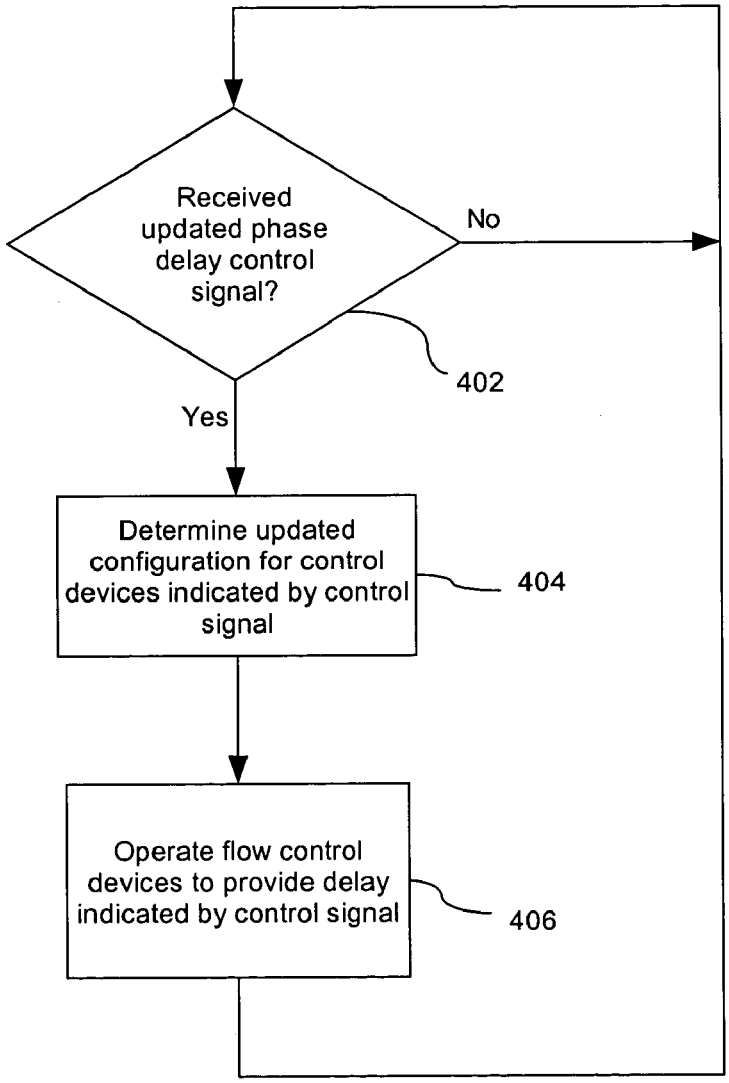
FIG. 4 is a flow chart that is useful for understanding the process of the invention.

FIG. 4 is a flowchart illustrating a process for producing a variable phase delay in accordance with a preferred embodiment of the invention. Referring to both FIG. 1 and FIG. 4, the process can begin in step 402 by controller 120 continually checking the status of an input buffer (not shown) for receiving control signal 122. If the controller determines that an updated phase delay control signal has been received on the control signal input line then the controller 120 continues on to step 404. In step 404, the controller 120 can determine the updated configuration for one or more fluid control devices 154 necessary to implement the phase delay indicated by control signal 122. For example, the controller can determine whether fluidic dielectric 132 should be added or removed from the fluid channel 130 in order to implement the necessary amount of phase delay.

Once the controller has determined the updated configuration for the fluid channel 130 necessary to implement the phase delay, the controller 120 can move on to step 406. In step 406, the controller operates the fluid control system 150 to implement the required delay.

The required configuration of the fluid control system can be determined by one of several means. One method would be to calculate the total phase delay for the transmission line 102. Given the amount of fluidic dielectric within the fluid channel 130 and the permittivity and permeability of the fluidic dielectric, and any surrounding solid dielectric 102, 142, the propagation velocity correlating to a requested phase delay could be calculated for the portions of the transmission line. These values could be calculated each time a new phase delay request is received or could be stored in a memory associated with controller 120.

As an alternative to calculating the required configuration of the fluid channel 130, the controller 120 could also make use of a look-up-table (LUT). The LUT can contain cross-reference information for determining control data for variable phase delay necessary to achieve various different delay times. For example, a calibration process could be used to identify the specific digital control signal values communicated from controller 120 to the various pumps and valves of the fluid control system 150 that are necessary to achieve a specific delay value. These digital control signal values could then be stored in the LUT. Thereafter, when control signal 122 is updated to a new requested phase delay, the controller 120 can immediately obtain the corresponding digital control signal for producing the required phase delay.

As an alternative, or in addition to the foregoing methods, the controller 120 could make use of an empirical approach that injects a signal at RF input port 110 and measures the phase delay at the RF output port 112. Specifically, the controller 120 could check to see whether the updated phase delay had been achieved. A feedback loop could then be employed to control the fluid control system 150 to produce the desired delay characteristic.

Those skilled in the art will recognize that a wide variety of alternatives could be used to adjust the presence or absence of the fluidic dielectric contained in each of the fluid channel 130. Accordingly, the specific implementations described herein are intended to be merely examples and should not be construed as limiting the invention.

RF Unit Structure, Materials and Fabrication

In theory, constant characteristic impedance can be obtained for a transmission line by maintaining a constant ratio of permittivity to permeability in the dielectric to which the line is coupled. Accordingly, in those instances where the transmission line is for all practical purposes coupled exclusively to the fluidic dielectric, then it is merely necessary to maintain a constant ratio of $\epsilon_r/\mu_r$, where $\epsilon_r$ is the permittivity of the fluidic dielectric 132, and $\mu_r$ is the permeability of the fluidic dielectric. 132.

However, in the case where the transmission line is also partially coupled to a solid dielectric, then the permeability $\mu r$ necessary to keep the characteristic impedance of the line constant can be expressed as follows:

$$\mu_r=\mu_{r,sub}(\epsilon_r/\epsilon_{r,sub})$$

where $\mu_{r,sub}$ is the permeability of the solid dielectric substrate 106, $\epsilon_r$ is the permittivity of the fluidic dielectric 132 and $\epsilon_{r,sub}$ is the permittivity of the solid dielectric substrate 106. When this condition applies, the effective index describing the velocity of the wave $n_{eff}$, is approximately equal to $n_{0,eff}(\epsilon_r/\epsilon_{r,sub})$ where $n_{0,eff}$ is the index in the solid dielectric substrate.

Note that when the dielectric properties of a transmission line are inhomogeneous along the direction of wave propagation, but the inhomogeneities are small relative to the wavelength in the medium, the line typically behaves like a homogenous line with dielectric properties between the extremes of the inhomogeneous line. Exceptions to this rule may occur when the inhomogeneities are periodic with a period harmonically related to the wavelength. In most other cases, however, inhomogeneous line will generally be characterized by an "effective permittivity" $\epsilon_{r,eff}$ and an "effective permeability" $\mu_{r,eff}$ which are merely the properties of the hypothetical equivalent homogeneous structure. This condition may apply to specific embodiments of the current invention if the fluid channel illustrated in FIG. 2 is small, for example where the diameter of the fluid channel is less than 1/10 of the wavelength in the medium. In this case, the fluid properties can be chosen to maintain a constant ratio of effective permeability to effective permittivity with respect to the transmission line with an empty fluid channel. This will maintain constant impedance with a variable index of refraction as described above. The scope of the invention is not restricted to transmission lines for which this condition is enforced.

At this point it should be noted that while the embodiment of the invention in FIGS. 1–3 are shown essentially in the form of a microstrip or buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. All such structures are intended to be within the scope of the invention.

According to one aspect of the invention, the solid dielectric substrate 106 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Those skilled in the art will recognize that a wide variety of alternatives could be used to adjust the distribution of the fluidic dielectrics. Accordingly, the specific implementations described herein are intended to be merely examples and should not be construed as limiting the invention.

We claim:

1. A variable phase delay line, comprising:

an RF transmission line;

a structure defining a fluid channel having a serpentine configuration, said fluid channel comprising a plurality of fluid channel segments that respectively traverse said RF transmission line at a plurelrty of locations spaced apart along a length of said transmission line and which are coupled to said RF transmission line along at least a portion of a length of said RF transmission line; and at least one fluid control system for adding and removing fluidic dielectric to said fluid channel in response to a phase delay control signal;

wherein a phase delay of said RF transmission line is selectively varied by at least one of adding and removing said fluidic dielectric from said fluid channel.

2. The phase delay line according to claim 1 wherein said fluidic dielectric is comprised of an industrial solvent.

3. The phase delay line according to claim 1 wherein said transmission line is also coupled to a solid dielectric substrate material.

4. The phase delay line according to claim 3 wherein the effective index describing the velocity of a wave on said RF transmission line is varied by adding and removing said fluidic dielectric from said fluid channel.

5. The phase delay line according to claim 3 wherein said solid dielectric substrate is formed from a ceramic material.

6. The phase delay line according to claim 3 wherein said solid dielectric substrate is formed from a low temperature co-fired ceramic.

7. The phase delay according to claim 3 wherein said fluidic dielectric has at least one of a permittivity and a permeability that is different as compared to said solid dielectric substrate.

8. A variable phase delay line, comprising:

an RF transmission line;

a structure defining a fluid channel having a serpentine configuration coupled to said RF transmission line along at least a portion of a length of said transmission line;

at least one fluid control system for adding and removing fluidic dielectric to said fluid channel in response to a phase delay control signal;

wherein a phase delay of said RF transmission line is selectively varied by at least one of adding and removing said fluidic dielectric from said fluid channel and said fluidic dielectric has a permeability and a permittivity selected for maintaining a constant characteristic impedance along an entire length of said RF transmission line.

9. A variable phase delay line, comprising:

an RF transmission line;

a structure defining a fluid channel having a serpentine configuration coupled to said RF transmission line along at least a portion of a length of said transmission line;

at least one fluid control system for adding and removing fluidic dielectric to said fluid channel in response to a phase delay control signal;

wherein a phase delay of said RF transmission line is selectively varied by at least one of adding and removing said fluidic dielectric from said fluid channel and said fluidic dielectric is comprised of an industrial solvent having a suspension of magnetic particles contained therein.

10. The phase delay line according to claim 9 wherein said magnetic particles are formed of a material selected from the group consisting of ferrite, metallic salts, and organo-metallic particles.

11. A constant phase delay line, comprising:

an RF transmission line;

a structure defining a fluid channel having a serpentine configuration, said fluid channel comprising a plurality of fluid channel segments that respectively traverse said RF transmission line at a plurality of locations spaced apart along a length of said transmission line and which are coupled to said RF transmission line along at least a portion of a length of said RF transmission line; and at least one fluid control system for adding and removing a fluidic dielectric to said fluid channel in response to a phase delay control signal;

wherein a phase delay of said RF transmission line is maintained constant as an operational frequency of said RF transmission line is varied, said phase delay maintained constant by at least one of adding and removing said fluidic dielectric from said fluid channel.

12. A method for producing a variable phase delay for an RF signal comprising the steps of:

propagating said RF signal along an RF transmission line; and adding a fluidic dielectric into a fluid channel having a serpentine configuration, said fluid channel comprising a plurality of fluid channel segments that respectively traverse said RF transmission line at a plurality of locations spaced apart along a length of said transmission line and which are coupled to said RF transmission line along at least a portion of a length of said RF transmission line, said fluidic dielectric being added to selectively control said coupling to vary a phase delay of said transmission line.

13. The method according to claim 12 further comprising the step of subsequently removing a portion of said fluidic dielectric from said fluid channel.

14. The method according to claim 12 further comprising the step of selecting a material for said fluidic dielectric to include an industrial solvent.

15. The method according to claim 12 further comprising the step of selecting said fluidic dielectric to have at least one of a permeability and a permittivity selected for maintaining a constant characteristic impedance along a length of said RF transmission line.

16. The method according to claim 12 further comprising the step of coupling said RF transmission line to a solid dielectric substrate material.

17. The method according to claim 16 further comprising the step of selecting a material for said solid dielectric substrate to be a low temperature co-fired ceramic.

18. The method according to claim 16 further comprising the step of selecting said fluidic dielectric to have at least one of a permittivity and a permeability that is different as compared to said solid dielectric substrate.

19. The method according to claim 16 further comprising the step of forming said solid dielectric substrate from a ceramic material.

20. A method for producing a variable phase delay for an RF signal comprising the steps of:

propagating said RF signal along an RF transmission line;

adding a fluidic dielectric into a fluid channel having a serpentine configuration and being coupled to said RF transmission line along at least a portion of a length of said transmission line, said fluidic dielectric being added to selectively control said coupling to vary a phase delay of said RF transmission line; and selecting a permeability and a permittivity for said fluidic dielectric for maintaining a constant characteristic impedance along an entire length of said RF transmission line.

21. A method for producing a variable phase delay for an RF signal comprising the steps of:

propagating said RF signal along an RF transmission line;

adding a fluidic dielectric into a fluid channel having a serpentine configuration and being coupled to said RF transmission line along at least a portion of a length of said transmission line, said fluidic dielectric being added to selectively control said coupling to vary a phase delay of said RF transmission line; and selecting a material of said fluidic dielectric to include an industrial solvent having a suspension of magnetic particles contained therein.

22. The method according to claim 21 further comprising the step of selecting said magnetic particles from the group consisting of ferrite, metallic salts, and organo-metallic particles.

23. A method for producing a constant phase delay for an RF signal comprising the steps of:

propagating said RF signal along an RF transmission line; and adding a fluidic dielectric into a fluid channel having a serpentine configuration, said fluid channel comprising a plurality of fluid channel segments that respectively traverse beneath said RF transmission line at a plurality of locations spaced apart along a length of said transmission line and which are coupled to said RF transmission line along at least a portion of a length of said RF transmission line, said fluidic dielectric being added to selectively control said coupling to maintain a constant phase delay of said transmission line as a frequency of said RF signal is varied.

* * * * *

UNITED STATES PATENT AND TRADEMARK OFFICE

CERTIFICATE OF CORRECTION

PATENT NO. : 6,998,937 B2
APPLICATION NO. : 10/656949
DATED : February 14, 2006
INVENTOR(S) : Brown et al.

It is certified that error appears in the above-identified patent and that said Letters Patent is hereby corrected as shown below:

Column 1

Line 41, delete " $\sqrt{L_1/C_1}$ where $L_1$" and replace with -- $\sqrt{L_1/C_1}$ where $L_1$ --.
Line 41, delete "$C_1$" and replace with -- $C_1$ --.
Line 42, delete "$L_1$ and $C_1$" and replace with -- $L_1$ and $C_1$ --.

Signed and Sealed this

Twelfth Day of February, 2008

JON W. DUDAS
*Director of the United States Patent and Trademark Office*